United States Patent [19]

Hudimac, Jr.

[11] Patent Number: 4,807,100

[45] Date of Patent: Feb. 21, 1989

[54] LIGHT DIRECTOR

[75] Inventor: George S. Hudimac, Jr., Allentown, Pa.

[73] Assignee: Mechanical Service Company, Allentown, Pa.

[21] Appl. No.: 28,395

[22] Filed: Mar. 20, 1987

[51] Int. Cl.[4] ..... F21M 3/14

[52] U.S. Cl. ..... 362/255; 362/290; 362/325

[58] Field of Search ..... 362/290, 255, 256, 279, 362/342, 444, 305, 343, 325; 313/110, 112, 117, 113

[56] References Cited

U.S. PATENT DOCUMENTS

| | | | |
|---|---|---|---|
| 1,464,884 | 8/1923 | Reeves | 362/255 |
| 1,578,704 | 3/1926 | Ash, Jr. | 362/255 |
| 1,717,067 | 6/1929 | Rosenbraugh | 362/255 |
| 1,759,985 | 5/1930 | Jenkins | 362/444 |
| 3,446,955 | 5/1969 | Bailey et al. | 362/290 |
| 3,657,530 | 4/1972 | Halonen | 362/255 |

FOREIGN PATENT DOCUMENTS

| | | | |
|---|---|---|---|
| 944833 | 4/1949 | France | 362/255 |
| 646251 | 11/1950 | United Kingdom | 362/290 |

*Primary Examiner*—Michael Koczo
*Assistant Examiner*—D. M. Cox
*Attorney, Agent, or Firm*—Frederick J. Olsson

[57] ABSTRACT

A light director has an elongated, hollow, opaque open-ended shield. The shield slips over the glass housing of a light bulb. A pair of small apertures on the side of the shield receive portions of the glass housing in a sliding engagement which provide for the shield to be oriented in several angular positions. A plurality of flat, spaced apart slats extend across one open end and function to cause the light to exit in generally parallel beams.

14 Claims, 1 Drawing Sheet

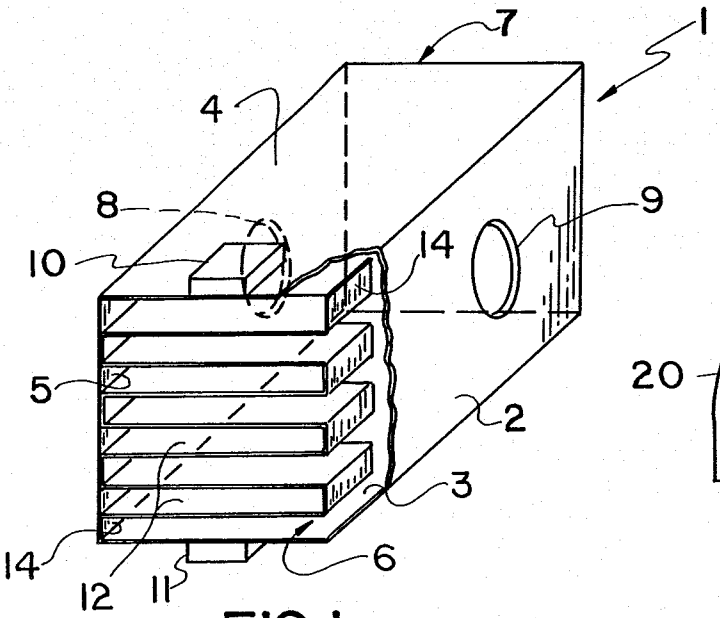
FIG. 1
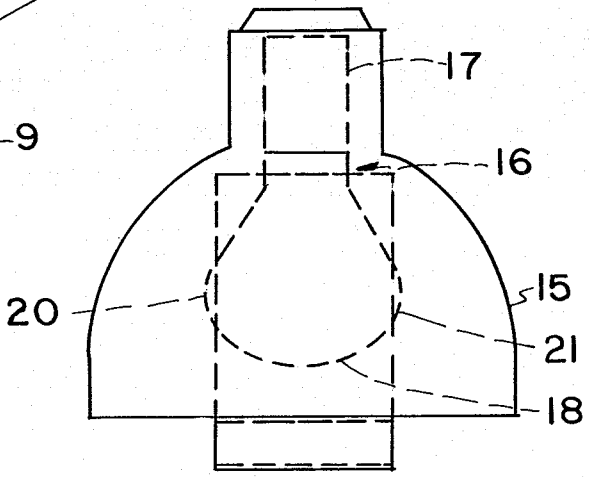
FIG. 2
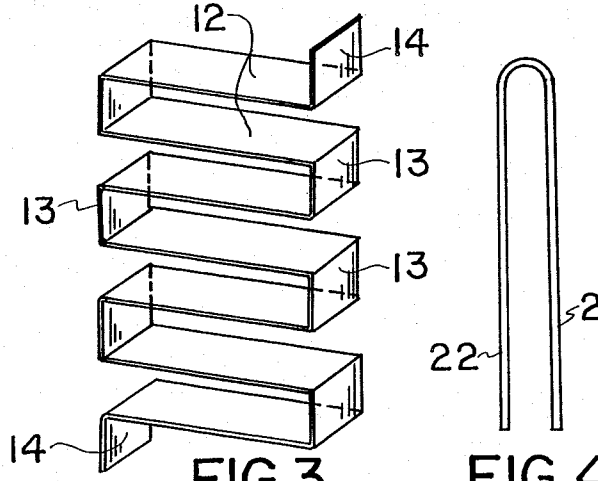
FIG. 3
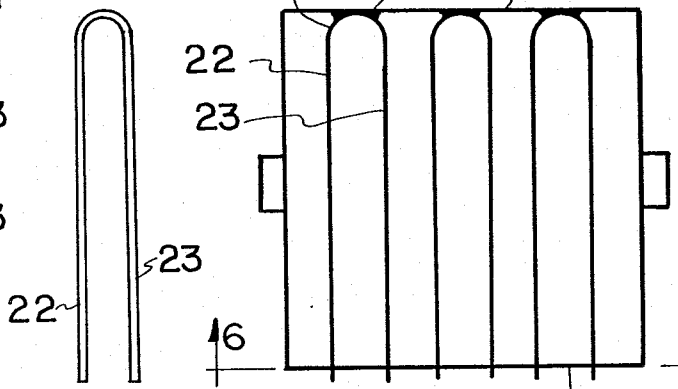
FIG. 4
FIG. 5
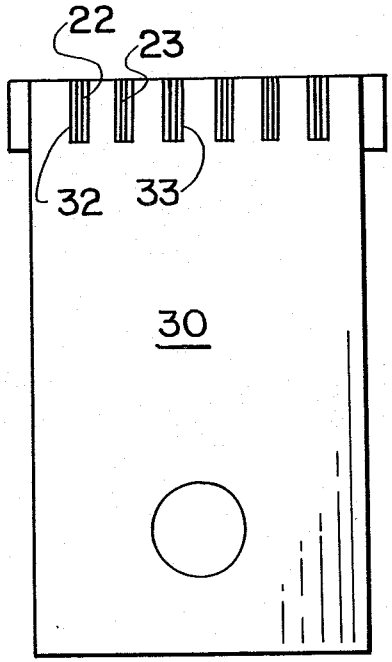
FIG. 6

LIGHT DIRECTOR

This invention relates in general to lighting fixtures and in particular relates to a device installed on a light bulb to gather light from the bulb and direct the light to a desired area.

The invention contemplates a light director comprised of an annular, hollow, elongated shield which can be slipped over the glass housing of a light bulb, the shield being opaque so as to confine the light radiating from the glass housing whereby the blocked light is directed along the length of the shield to an opening which has a gate or a plurality of flat slats to arrange the exiting light in parallel rows. The shield can be rotated and swiveled on the glass housing to position the director in any of a wide variety of angular orientations so that the gate directs the light to an area desired.

One example of the use of the light director for light blocking and light directing is with the conventional bed reading light which consists of a bulb and a surrounding reflective shade. When such a light is used for reading purposes by a person on one side of the bed, the light invariably shines on the person on the side of the bed who may be attempting to sleep. With the present invention, the light can be directed to the person reading, but blocked off to the person on the other side simply by slipping the director over the bulb and adjusting to the desired orientation.

Another example of the use of the light director for light blocking and light directing while providing decorative effects is with an outdoor floodlight trained on a house, a bush, a tree, or the like. With the present invention, the flood characteristics of the light is eliminated and the light directed out through the gate onto the particular area desired. Where a flood light employs colored bulbs, the director will permit color emphasis on the object illuminated.

One example of use of the light director primarily for decorative effects is where the shield is slipped over the bulb of a table lamp to prevent the light from shining through the shade and directing the light up through the top of the shade toward the ceiling.

The invention will be described in connection with the drawings wherein:

FIG. 1 is a perspective view of one form of the light director of the invention arranged for use with conventional 120-volt light bulbs;

FIG. 2 is a view illustrating the light director of FIG. 1 as employed in a conventional bed reading lamp;

FIG. 3 is a perspective view of one way of constructing the gate or slats used in the light director of FIG. 1;

FIG. 4 is an elevational view to illustrate another way of constructing the gate or slats of the invention;

FIG. 5 is an end view of a light director of the invention whose gate or slats are formed from the arrangement shown in FIG. 4;

FIG. 6 is a view taken along the lines 6—6 of FIG. 5.

The invention is presented in connection with a conventional 120-volt bulb. As suggested above and as will be evident from the following description, the director of the invention may be employed with other type bulbs.

Referring to FIG. 1, the shield 1 has four sides 2, 3, 4, and 5 arranged in the form of a square and dimensioned to be slipped over the glass housing of a light bulb. The opposite ends 6 and 7 of the shield are open. The sides 2 and 5 have apertures 8 and 9. Adjacent the end 6 is a plurality of slats or a gate 12. The sides 3 and 4 carry blocks 10 and 11 which are made of insulating material such as a phenolic and secured in place with a high temperature adhesive. The pads are for use in being contacted by the fingers for adjusting the shield on the glass housing and for removing.

Both the inside and outside of the shield may be provided with a non-reflecting surface or the inside surface may be reflecting while the outside surface is non-reflecting.

The slats comprising the gate 12 are parallel to each other and parallel to the sides 3 and 4. As will be evident, the several slats extend inwardly. The surfaces of the slats may have a reflecting surface or may be black and non-reflecting.

The shield is preferably made from a blank of 0.010" thick mild steel having the apertures 8 and 9 punched out and one edge formed with a small offset. The blank is folded into the square shape shown with the edge opposite the offset nested therein. The square is then spot welded along the nested area.

As respects the reflecting and non-reflecting surfaces, these may be created by conventional techniques. For example, if both the inside and outside surfaces are to be non-reflecting, the black oxiding dip technique is employed. If one surface is to be reflective and the other non-reflective, the surface to be reflective is masked off during the dip and then highly buffed after the dipping operation.

One manner of constructing the gate or plurality of slats 12 is shown in FIG. 3. A strip of the same kind of steel as mentioned above is bent into the respective arrangement shown. Naturally, the gate is dimensioned so that it can be pushed into the open end 6. Spacers 13 extend between adjacent slots. The free ends 14 are respectively welded to sides 2 and 5.

The use of the light director of FIG. 1 on a conventional bed reading lamp is shown in FIG. 2.

The lamp has a reflector 15 which carries a socket to hold a conventional light bulb 16. The bulb has a base 17 which screws into the socket of the lamp together with a glass housing 18. The light director 1 is installed simply by pushing the same over the bulb until the apertures 8 and 9 receive portions of the glass housing as indicated at 20 and 21. The engagement of the edges of the apertures with the glass housing make a sliding fit much in the manner of a ball joint so that the director can be rotated or swiveled. The foregoing permits the director to be set up in a wide variety of angular orientations on the glass housing.

With the sides 2, 3, 4, and 5 being opaque, the light radiating from the glass housing will be substantially confined and directed out of the open ends and, of course, to some extent out of the apertures 8 and 9. To reduce this light, the apertures 8 and 9 are of minimal size; i.e. just sufficient to retain the director firm in adjusted position. Also, to block off the light from the apertures 8 and 9, the director may be provided with small caps welded to the sides 2 and 5 and covering the apertures 8 and 9 but spaced away out of contact with the portions of the glass housing in the apertures.

With respect to the light radiating from the glass housing adjacent the base 17, the shield 1 extends closely adjacent the base 17 (FIG. 2) so that such light radiation is minimized. Also, the filament of the bulb is located near the opposite end of the bulb and this is a factor in reducing radiation adjacent the base.

The embodiment of the director illustrated in FIGS. 4, 5, and 6 incorporates a form of gate or plurality of slats designed to accomodate the affects of heat expansion of the slats.

The slats are formed in pairs and each pair welded in position. Thus, a pair of slats 22 and 23 (FIG. 4) are formed from a stip bent into a horseshoe shape. The base 24 of the pair is welded to the side 25 as by the weld 26. Additional pairs are set up in an identical format.

As to the expansion aspect, the side 30 is provided with a number of slots corresponding to the number of slats. This is indicated in FIG. 6 where it will be seen that the ends of the slats 22 and 23 extend into the slots 32 and 33. The foregoing arrangement is to avoid buckling of the slats due to heat expansion.

Before closing, it is pointed out that with respect to the slats 12, the flatness, the amount of inside extension, and the parallel relationship all cooperate to cause the light exiting through open end 6 to be in generally parallel beams.

What is claimed is:

1. In combination:

a light bulb comprising a glass housing and a base;

an elongated, hollow, opaque shield at least one end of which is open, the shield being slidably mounted on said glass housing with the inside of the shield slidingly engaging the glass housing and the sliding engagement allowing the shield to be moved on the housing to a plurality of positions;

a plurality of flat, spaced apart slats connected to the shield adjacent to and inside of said open end spaced from said light bulb and extending parallel to one another across the open end and also extending inside the shield in a direction toward said glass housing; and the flat slats the amount of slat inside extension, and parallel slats cooperating to cause light from said glass housing to pass through said open end in generally parallel beams.

2. In combination:

a light bulb comprising a glass housing and a base;

an elongated, hollow, opaque shield at least one end of which is open, the shield having a pair of mounting apertures each receiving a portion of the glass housing with at least a portion of the edge of each aperture slidingly engaging the glass housing to provide the means by which the shield is mounted on said glass housing, the sliding engagement providing for the shield to be moved on the glass housing to a plurality of positions;

a plurality of flat, spaced apart slats connected to the shield adjacent to and inside of said open end and spaced from said light bulb and extending parallel to one another across the open end and also extending inside the shield in a direction toward said glass housing; and the flat slats, the amount of slat inside extension, and the parallel slats cooperating to cause light from said glass housing to pass through said open end in generally parallel beams.

3. The combination of claim 2:

further including a plurality of spaced apart expansion slots arranged side by side in the shield adjacent said open end; and wherein a corresponding end of said slat being welded to said shield and the corresponding opposite ends of the slats respectively extending through said expansion slots.

4. The combination of claim 2 wherein:

pairs of adjacent slats are formed from a U-shaped member with the base of each U-shaped member being welded to said shield.

5. The combination of claim 2 wherein said plurality of slats are formed from a unitary member including a plurality of spacers respectively between adjacent slats and for each slat, reverse bends means connecting the slat and the adjacent spacer and with opposite ends of the member being welded to said shield.

6. The combination of claim 2 further including adjusting means on the shield adjacent said open end and made of insulating material, the adjusting means being for use in positioning the shield on the glass housing.

7. Light director means comprising:

an elongated, hollow, opaque shield at least one end of which is open, the shield being constructed with a bulb portion to fit over and receive the glass housing of a light bulb in sliding engagement therewith and constructed with a slat portion to receive light directing slats; and a plurality of flat, spaced apart, slats connected to the shield adjacent to and inside of said one open end and extending parallel one another across the open end and also extending inside the shield toward the center thereof so as to be disposed in said slat portion and the amount of the inside extention being determined so that the ends of the slats will be spaced from a light bulb on which the shield is mounted.

8. Light director means comprising:

an elongated, hollow, opaque shield at least one end of which is open, the shield being constructed to fit over the glass housing of a light bulb and having a pair of mounting apertures each for receiving respective portions of the glass housing with at least a portion of the edge of each aperture slidingly engaging the glass housing to provide the means by which the shield can be mounted on the glass housing, the sliding engagement providing for the shield to be moved on the glass housing to a plurality of positions; and a plurality of flat, spaced apart slats connected to the shield adjacent said open end and extending parallel one another across the open end and also extending inside the shield toward the center thereof.

9. The light director of claim 8 further including:

a plurality of spaced apart slots arranged side-by-side in the shield adjacent said open end; and wherein one end of each said slats is welded to said shield and the opposite ends of the slats respectively extend through said slots.

10. The light director of claim 8 wherein:

pairs of adjacent slats are formed from a U-shaped member with the base of each U-shaped member being welded to said shield.

11. The light director of claim 8 wherein:

said plurality of slats are formed from a unitary member including a plurality of spacers respectively between adjacent slats and for each slat, reverse bend means connecting the slat and the adjacent spacers and with opposite ends of the member being welded to said shield.

12. The light director of claim 8 including adjusting means on the shield adjacent said, open end and made of insulating material, the adjusting means being for use in positioning the shield on the glass housing.

13. The structure of claims 1, 2, 7, or 8 further including means on the inside surface of said shield which provides for the surface to be light reflecting and means on the outside surface of said shield which provide for the surface to be non-light reflecting.

14. The structure of claims 1, 2, 7, or 8 further including means on the inside surface and the outside surface of said shield and on the surfaces of said slats which provides for said surfaces to be non-light reflecting.

* * * * *